US005131474A

United States Patent [19]

Hunter, III

[11] Patent Number: 5,131,474

[45] Date of Patent: Jul. 21, 1992

[54] MOBILE COMBINED OXYGEN-FREE WORK COMPARTMENT AND FIRE EXTINGUISHER FOR OIL WELL BLOWOUTS

[76] Inventor: Henry L. Hunter, III, 334 Bedford Rd., Pleasantville, N.Y. 10570

[21] Appl. No.: 717,272

[22] Filed: Jun. 18, 1991

[51] Int. Cl.[5] ..... A62C 3/00

[52] U.S. Cl. ..... 169/46; 169/52; 169/69

[58] Field of Search ..... 169/69, 43, 46, 52

[56] References Cited

U.S. PATENT DOCUMENTS

| | | | |
|---|---|---|---|
| 1,830,061 | 11/1931 | Howe | 169/69 X |
| 1,859,606 | 5/1932 | Sievern et al. | 169/69 X |
| 3,730,278 | 5/1973 | Roy | 169/69 X |

OTHER PUBLICATIONS

Sayers, Bob, "Capping Blowouts from Iran's Eight--Year War", *World Oil*, 212: pp. 44–48 (May 1991).

Hayes, Thomas C., "The Job of Fighting Kuwait's Infernos", *The New York Times*, pp. D1, D5 (Feb. 28, 1991).

*The New York Times*, pp. A1,A13 (Apr. 9, 1991).

*Primary Examiner*—Margaret A. Focarino
*Assistant Examiner*—Andrew C. Pike
*Attorney, Agent, or Firm*—Charles J. Herron

[57] ABSTRACT

A mobile apparatus provides a safe environment for controlling oil wellhead gushers and fires at such gushers. It includes a main compartment, having a gas exchange lock access, and a flue stack, having a flue outlet, which form a gastight enclosure at the area around the wellhead. The flue stack opens to atmosphere at the flue outlet and a portion of the flue stack is moveable to control the size of the opening and, thus, the flow rate of exiting gases. A nonflammable environment is established in the apparatus, any fire present at the wellhead is relocated exterior to the enclosure, and the relocated fire is extinguished. The apparatus can be provided with at least one baffle that temporarily retains liquids impinging on it while not preventing the flow of gases from the enclosure, and a recovery basin that is positioned below the liquid-gas separation baffle(s) so as to collect and pass the liquids so collected exterior to the apparatus for recovery.

12 Claims, 4 Drawing Sheets

MOBILE COMBINED OXYGEN-FREE WORK COMPARTMENT AND FIRE EXTINGUISHER FOR OIL WELL BLOWOUTS

BACKGROUND OF THE INVENTION

1. Field Of The Invention

The invention relates to an apparatus and method for the containment and control of wellhead blowouts, and particularly to the control and extinguishment of oil wellhead fires.

2. Description Of Related Art

Experts in the field of controlling wild wellheads and fighting oil well fires have long accepted a single standard method for combatting the enormous forces and dangers these wild wells and fires present. First, well in advance of fire fighters approaching the wellhead and fire area, large volumes of water are pumped into the fire area from a "safe" distance to cool the area for the fire fighters as they work. This man-made rain is continued throughout all subsequent operations. Then, a tractor-mounted crane assembly is used to remove destroyed equipment, debris, and everything that might possibly retain heat above the flash point of raining oil from the fire site. Once this is done, large amounts of explosives are brought in and detonated on or above the base of the fire to consume or interrupt the supply of oxygen, thereby extinguishing the fire. New control valves, piping and other desired equipment are fitted onto wells that can be salvaged, i.e., their preexisting production string and related equipment is not so severely damaged that it cannot control the continuing flow of oil. Irreparably damaged wells are permanently capped. In cases where an explosion has destroyed the production pipe and surrounding equipment near the ground surface, a parallel "relief"well is drilled and the flow of oil is diverted in order to starve the wellhead of its source of crude oil. For a recent description of this standard procedure, see Sayers, "Capping Blowouts from Iran's Eight Year War," World Oil, 212:44–48 (May 1991) and the New York Times, page D1, on Feb. 28, 1991.

In a modification of this procedure, a tapered nozzle called a "stinger" is forced into the oil pipe. Pieces of rubber and rope are injected through the nozzle. These materials are picked up by the exiting oil and wedged between the nozzle and the wall of the production pipe to form a seal. When the seal is good enough so that leaks are not excessive, a thick mud slurry that is heavier than the oil is pumped into the production string to close down the oil flow. Subsequent work must be done at the well site by hand under extremely adverse conditions of heat and other factors.

An experimental device for extinguishing wellhead fires was also reported recently in the New York Times. The device was described as not requiring large amounts of water, as is required by the above-described approach. The device consists of a large tube at the end of a boom mounted on a bulldozer having a sheet metal cabin to shield the operator from the heat. The tube is to be jammed over the blazing oil pipe, funneling the fire, and either inert nitrogen gas or water is then to be pumped in to separate the flame from the oil fueling it and to cut off the supply of oxygen.

Other approaches, as reported in the New York Times of Apr. 9, 1991, include robots that launch flame-eating chemicals portable factories that spew supercold foams, air guns that cut through wreckage around wells, explosive charges that seal oil pipes, and 100-ton concrete caps that fit over the wheelhead to snuff out flames hundreds of feet high and drain away the gushing oil through pipes. It is reported that the last two simultaneously stop the uncontrolled gushing of oil.

As such, presently known methods (1) are generally quite destructive, (2) are generally very slow, (3) require large teams of workers, (4) require large amounts of water, (5) are extremely dangerous to the work teams, (6) create uncomfortable working conditions, and (7) are restrictive in the types of tools that can be used because of the risk of spark-induced reignition or explosion.

SUMMARY OF THE INVENTION

The present apparatus and methods eliminates or substantially alleviates each of the above problems. For example, the apparatus and method of the invention (i) causes little or no additional damage to anything at the well site; (ii) allows teams of workers to extinguish a gushing oil wel fire and control the gusher in a much reduced time frame; (iii) significantly reduces the amount of water required; and (iv) create a nonexplosive, nonflammable working environment for controlling the gusher and, thus, allows the safe use of normal tools, such as welders, cutting torches, grinders, spark producing electric power drills, and the like. Since the work area is oxygen-free, workers will use self-contained individual breathing gear, additionally providing an air source significantly cleaner, and therefore safer, than the ambient atmosphere in the area of the wellhead.

Accordingly, the invention provides a mobile apparatus providing a safe environment for controlling oil wellhead blowouts and fires at such wellhead blowouts. The apparatus includes a housing having a substantially oxygen-free interior environment and comprising (i) a main compartment providing a work section encompassing the wellhead and (ii) an exhaust stack having an interior continuous with that of the main compartment and an outlet to which any wellhead fire present is relocated. The apapratus also includes component(s) associated with the housing for providing a substantially oxygen-free environment therein; an airlock-type feature attached to the housing for accessing the main compartment while not compromising the oxygen-free environment therein; and component(s) for extinguishing any relocated wellhead fire.

A preferred embodiment of the invention further includes an assembly within an upper section of the main compartment for separating liquids from gases emanating from the wellhead. This assembly can include, for example, at least one baffle that diverts the flow of liquids impinging on it while not preventing the flow of gases from the exhaust stack opening. This assembly can further include means for recovering the separated liquids, such as a recovery basin positioned below the liquid-gas separation assembly. This can be further adapted to pass the liquids so separated out of the housing for recovery.

The invention further provides a method for providing a safe environment for controlling oil wellhead blowouts and fires at such wellhead blowouts. The method comprises (a) enclosing the wellhead in a substantially oxygen-free interior work environment having an outlet to which any wellhead fire present is relocated and (b) extinguishing any fire so relocated.

DETAILED DESCRIPTION OF PREFERRED EMBODIMENTS

Figure 1:
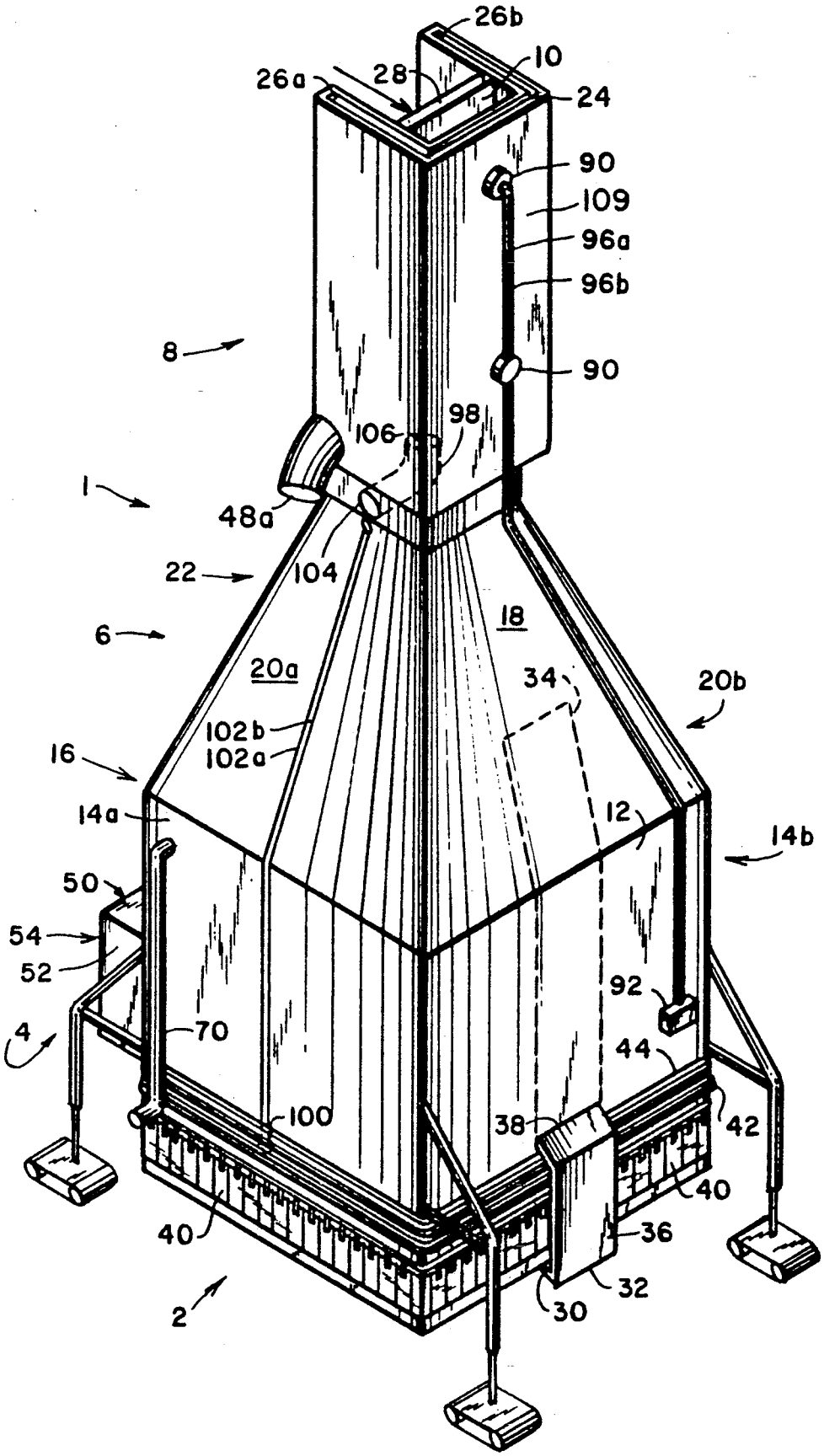
FIG. 1 is a perspective view of the apparatus of the invention in its raised, mobile configuration, with blast blade and shield down and ground surface drop plates and flexible skirts up.

Certain preferred embodiments will now be described in more detail, although they are not limitative of the scope of the invention.

As noted, the housing comprises (i) a main compartment that provides a work area encompassing the wellhead and (ii) an exhaust stack having an interior continuous with that of the main compartment and an outlet to which any wellhead fire present is relocated. The housing rests on the ground surface surrounding the wellhead and is provided with a gas exchange and pressure control system. The exhaust stack opens to atmosphere through an adjustable exhaust stack outlet. The main compartment can further include a gas/liquid separation/recovery assembly comprising (i) means within an upper section of the housing for separating liquids from gases emanating from the wellhead and (ii) means for recovering the liquids so separated.

Preferably, the base of the work area compartment is provided with exterior, vertically retractable panels and inner and outer flexible skirts surrounding the base and plates and adapted to be in substantially, gastight contact with the main compartment and the surface surrounding the wellhead. One preferred embodiment is illustrated in, and later described with respect to, the drawings. In another embodiment a second, outer array of drop panels is enclosed with the first, or inner, set at the top. The interior (facing) surface of each array is provided with a flexible skirt that unfurls to an extent that the flexible skirts overlap on the ground surface and can be held in place by the gas pressure introduced between them and, optionally, additional ballasting. A nonflammable and oxygen-free exhaust gas is introduced into the housing before it is positioned over the wellhead and between the skirts during use. Flammable gases are directed to the fire at the exhaust stack outlet at a controlled rate of release from the housing. A controlled gas pressure is maintained in the housing that is less than that established between the skirts and greater than that of the ambient atmosphere. This provides a system and method for purging the enclosure means of any oxygen-containing, fire supportive gases prior to its being moved into position at the wellhead and during operation.

In one aspect of the invention it has been recognized that it is desirable for the apparatus to provide a working environment that is reliably oxygen-free. Since the locations where the apparatus of the invention will be used will generally have at least somewhat irregular ground surfaces and may also be scattered with equipment debris, the apparatus provides for overcoming this problem. The base of the housing around the main work compartment is adapted to be in gastight contact with the ground. Any leakage that occurs is controlled such that it will not mix flammable gases with oxygen-containing gases, either inside or outside of the work area. In the preferred embodiment this is achieved by causing any leaks at the seal around the base to result in an inward flow of nonflammable and oxygen-free gas.

A preferred assembly at the base of the housing that cooperates with other components of the apparatus to accomplish this includes (i) a barrier of interlocking or overlapping plates that retract against the outer surface of the base and are independently vertically moveable to conform with the contours of its surrounds, (ii) an inner flame-resistant flexible skirt in gastight attachment with the exterior of the housing above the top position of retraction of the plates, and (iii) an outer flame-resistant flexible skirt attached to the housing above the inner skirt. The periphery of the outer skirt extends beyond that of the inner skirt and is weighted down with sand or other available materials. Alternatively, the periphery of the outer skirt is fitted with a flexible tube that is filled with liquids, slurries, or other ballast to form a substantially, gastight seal with the ground. Oxygen-free, nonflammable cooled flue gases are pumped between the inner and outer skirts to establish a pressure therebetween that is slightly greater than the pressure within the housing. This pressure differential causes the inner flexible skirt to be sucked against the exterior of the interlocking plates and the surrounding ground surface, thereby forming a gastight seal at the base of the housing.

Placement of the apparatus is preferably done by lifting it over any protrusions, such as "Christmas trees" and fences; driving it through the burning gusher with a protective shield; removing the protective shield; setting it down over the top of the gusher; and sealing the edges. Alternatively, in cases where there is a very tall structure, such as a tower over the gusher site (burning or not), placement can be made by opening up the front face, driving the unit in place, closing the wall, and then setting the unit down.

A preferred embodiment of the means for accessing the work area comprises a gas exchange chamber having gastight inner and outer chamber doors and means for positive pressure exchange of gases in the gas exchange chamber. A preferred system for the positive pressure gas exchange comprises means for positive pressure introduction of flue gas into the gas exchange chamber and exit means for purging the gas within the gas exchange chamber.

In a preferred embodiment, the pressure of the oxygen-free flammable environment within the apparatus is maintained by an assembly that permits a controlled burn at the base of the exhaust stack.

Control of exhaust gas velocity is by adjustment of the size of the cross-sectional area of the exhaust stack.

In practice, there is a limit to the reduction in outlet area dictated by the ability of the primary pressure regulator to reduce the pressure within the work area.

In a preferred form, the controlled gas pressure within the housing is achieved by means adapted to regulate the rate of nonturbulent flow out of the exhaust stack either manually or under the control of a mechanism sensitive to the velocity of the exit gas. The outward flow rate (cubic feet per minute) is the same as that coming from the well. The outward velocity (feet per minute) and to some extent its back pressure (pounds per square inch) is controlled by the area of the exhaust stack outlet.

As previously noted, in a preferred embodiment the apparatus further comprises an assembly within the housing for separating liquids from gases emanating from the wellhead. Preferably, the separating component of the assembly comprises at least one baffle that temporarily retains liquids impinging on it while not preventing the flow of gases from the housing. This assembly further comprises means for recovering the liquids so separated. In its preferred embodiment, the recovery means comprises a recovery basin that is positioned below the liquid-gas separation means so as to collect liquids so separated and adapted to pass the liquids so collected exterior to the housing. The principle advantages achieved thereby are the avoidance of splatter and flooding in the work area. The recovery basin can also be provided with an accessway for workers. The accessway also effects any necessary equalization of gas pressure between the work area section and the separation/recovery section of the main compartment.

In another embodiment, the oil recovery basin is adjustable in height. The ladder and the oil drain pipe are telescopic. The basin can be raised high above the gushing well in order to utilize the housing as an enclosed pipe handling facility if it is necessary to lower a string or other things into the well. Or the basin can be lowered to within about 6 feet of the wellhead, if the gusher out of the wellhead is spraying out at a wide angle. Or, in cases where the gusher is so wide spread that the spray is going in every direction at once, the work area can take the spray without the benefit of the liquid/gas separation recovery section and the gushing material will simply splatter around and run down the walls of the work chamber and rain inside. The work chamber will still be just as safe a work environment; it simply will not be as comfortable a place to work.

In a preferred form, a travel crane is attached to the underside of the oil recovery basin.

In a preferred form, an iron grid flooring can be hinged down from the inside. Cherry picker buckets can swing workers, tools, equipment, and supplies conveniently around inside. The buckets can be equipped with viewing shields. And much can be done remotely via cameras and remote control robotics. In short, inside the portable safety environment any operation can be carried on that could be done without it if there were no explosive environment to contend with.

Final extinguishing of the fire after the gusher has been stopped is preferably achieved by the controlled purge of flammable gases from the housing and deprivation of these gases from the relocated fire as well as replacing (purging) of the flammable gases exiting the work area via the relocation means with nonflammable non-oxygen-bearing gases.

Control of the relocated fire begins by adjusting the velocity of flow of flammable gases issuing from the exhaust outlet. A high, smooth (laminar flow) exit velocity of the flammable gases, coaxially surrounded by nonflammable flue gases, carries them high above the outlet and away from the housing before mixing of flammable gases occurs with ambient oxygen-containing air, where burning is reestablished. This is done by narrowing the cross-sectional area of the exit stack. The more it is closed, the faster is the exit velocity. However, the opening is not closed to an extreme that would result in excessive back pressure, since excessive back-pressure would potentially jeopardize the gastight integrity of the housing at its base.

In a preferred embodiment, a small elbow duct, fitted with a sealable, adjustable damper, introduces oxygen-containing ambient atmosphere into the lower portion of the exhaust stack where a small controlled burn takes place. This produces a "chimney effect" which reduces the pressure below. Control of the chimney burn is regulated by the damper in the elbow duct. This regulation is responsive to maintain the difference in pressure between the flammable gas pressure inside the work compartment and the manufactured flue gases between the inner and outer skirts.

Turning now to the drawings, FIG. 1 shows the well blowout safety apparatus, generally designated 1, that includes housing 2 having (i) work section 4, (ii) gas/liquid separation/recovery section 6, and (iii) exhaust stack 8 which are substantially gastight connection, such as by being integrally formed or welded together. Exhaust stack 8 opens to atmosphere at exhaust stack outlet 10.

Work section 4 is defined by the lower portions of front wall 12, side walls 14(*a*) and 14(*b*), and rear wall 16. Separation/recovery section 6 is defined by the upper portions of these same walls and also by front panel 18, side panels 20(*a*) and 20(*b*), and rear panel 22, each of which is inwardly inclined to the cross-sectional area of exhaust stack 8. The bottom edges of these inwardly inclined panels are continuous or sealed with the upper edges of front wall 12, side walls 14(*a*) and 14(*b*), and rear wall 16, respectively.

Exhaust stack 8 is defined by front stack panel 24, side stack panels 26(*a*) and 26(*b*), and rear stack panel 28. As shown, rear panel 28 is moveable. When fully open stack opening 10 is, for example, about 20 feet by 20 feet. The bottom edges of panels 24, 26(*a*), 26(*b*), and 28 are continuous or sealed with the upper edges of front panel 18, side panels 20(*a*) and 20(*b*), and rear panel 22, respectively.

The walls and panels can be, for example, of corrugated metal and can comprise more than one layer with supporting structure between layers. The inside wall surfaces can optionally have a coating of insulating ash in a binder of intumescent paint.

Front wall 12 is fitted with blast blade 30 that includes a narrow "V" shaped blade edge 32. Front wall 12 is also provided with interior blast plate 34. Blast plate 34 is formed of heavily reinforced iron or similar fire resistant and structurally rigid material, particularly on downwardly facing portions that must withstand the full and direct dynamic forces of the gusher G and fire. Interior blast plate 34 extends vertically the full length of front wall 12 and continues up along a predetermined portion of front panel 18. The portion of interior blast plate 34 that is associated with front panel 18 is also particularly heavily reinforced as it extends diagonally along with front plate 18 over the path of the gusher G and fire plume as apparatus 1 is moved into position.

Impingement shield 36 is removably attached by attachment mechanism 38 to front wall 12 and covers the portion of wall 12 and components attached thereto, as described below, and protects them as apparatus 1 is moved into position through the blowout gusher G. Blade edge 32 and impingement shield 36 are exposed to the dynamic force of the blowing gusher G as housing 2 is moved over and encloses the source of the gusher G, after which impingement shield 36 is removed. See FIG. 2.

A barrier of interlocking drop panels 40 are attached to the exterior of housing 2 near its base and are independently vertically moveable. Until apparatus 1 is lowered into position, they are held in their upper and retracted position. Panels 40 are then dropped to conform with the contours of the ground.

Inner flame-resistant flexible skirt 42 is in gastight attachment with the exterior of housing 2 above the fully retracted position of panels 40. Outer flame-resistant flexible skirt 44 is attached to housing 2 above inner skirt 42. Thus, flue gas containment skirts 42 and 44 are in gastight attachment to the lower exterior portion of work section 4 at a level above that occupied by panels 40 when in their upper, retracted position. The periphery of outer skirt 44 extends beyond that of inner skirt 42 and is provided with a tubular periphery 45 that is filled with ballasting material that conforms and secures skirt 44 to the contours of the surrounding ground surface. Alternatively, the periphery of skirt(s) 44 can be covered with locally available materials, such as sand, rock, or the like. Additionally, either dirt or sand landfill can be moved into the area in advance to form a uniform surface with which fire base enclosure 2 can form a gastight seal when lowered into position.

Outer skirt 44 has a flue gas inlet 46 connected by flexible flue gas pipe **48*b* to an external source (not shown in FIG. 1) of noncombustible, non-oxygen bearing flue gas. These gases are generated by conventional oil burners and the resultant flue gases are cooled by ambient air and an optional coaxial cooling jacket (not shown) as they pass through flexible flue gas pipe 48*b*. These flue gases inflate outer skirt 44 at a pressure of about 0.1 psi. Thus, if there are any leaks at the base of work section 4, such leaks will expel noncombustible flue gases into work section 4, rather than permit entry of oxygen-containing atmosphere into the work area. This also prevents combustible gases escaping from the wellhead from leaking out to the ambient atmosphere. This pressure differential causes inner skirt 42 to be lightly pressed against the exterior of interlocking panels 40 and the surrounding ground surface, thereby forming a gastight seal at the base of housing 2**.

Skirt 42 and 44 each preferably comprise one or more layers of fiberglass or other heat-resistant sheet material, such as are made of KEVLAR ® brand of aramid fiber (DuPont). Skirts 42 and 44 are rolled or folded up and secured to the exterior of work section 4 when not in use, such as when fire containment apparatus 1 is being transported from one site of use to another.

Access lock 50 is attached to rear wall 16 and includes access lock chamber 52, outer gas tight door 54, and inner gastight door 56. Access lock 50 is provided with means for positive pressure exchange of gases 57, shown in phantom. Thus, access lock 50 provides means for entry of workers and their equipment without compromising the oxygen-free characteristics of the interior environment by introduction of ambient atmosphere.

Figure 2:
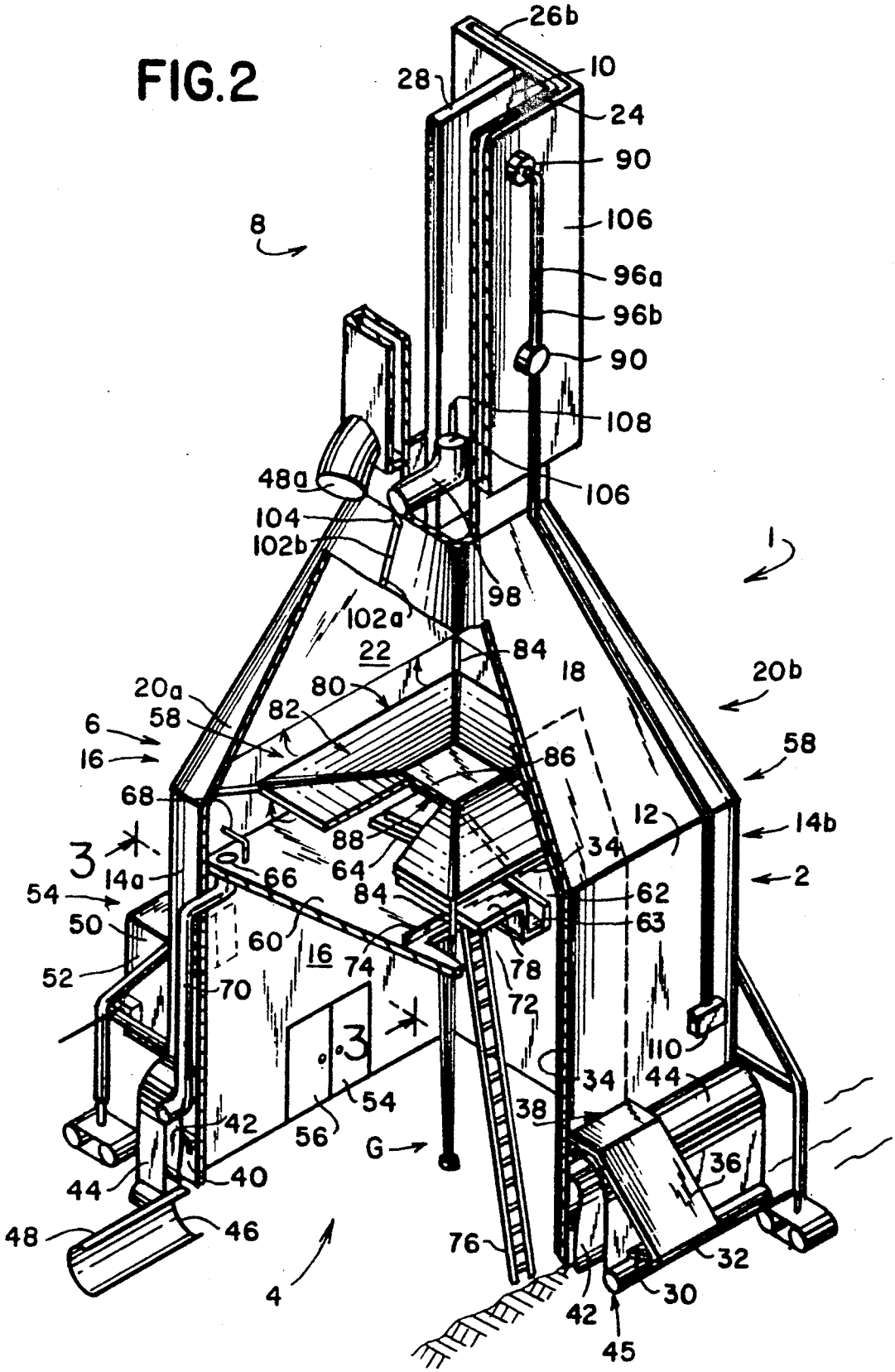
FIG. 2 is a perspective view of the apparatus shown in FIG. 1, broken away to show internal components and in which the blast blade and shield are raised, the housing has been lowered to the ground, and the skirt panels and skirts are down.
Figure 3:
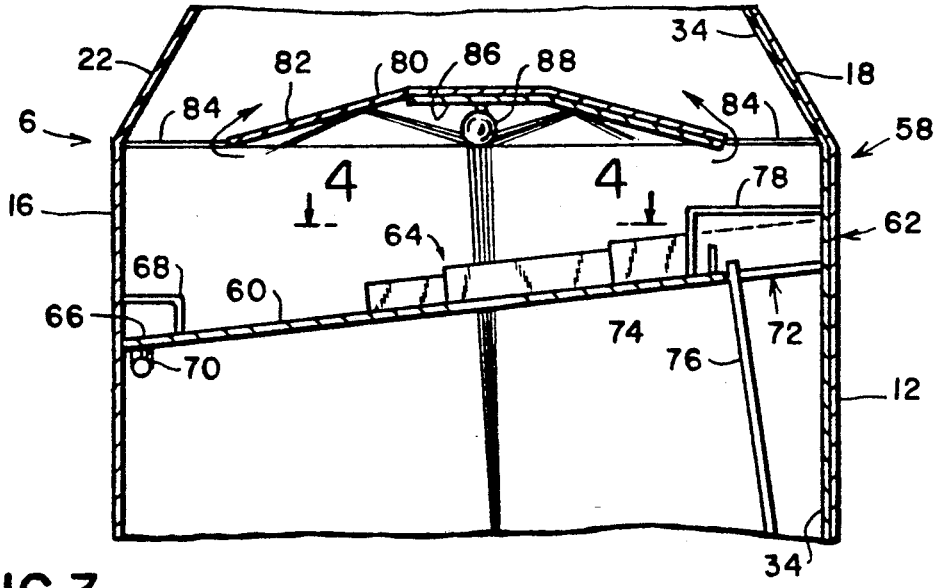
FIG. 3 is a cross section taken along line 3—3 in FIG. 2.
Figure 4:
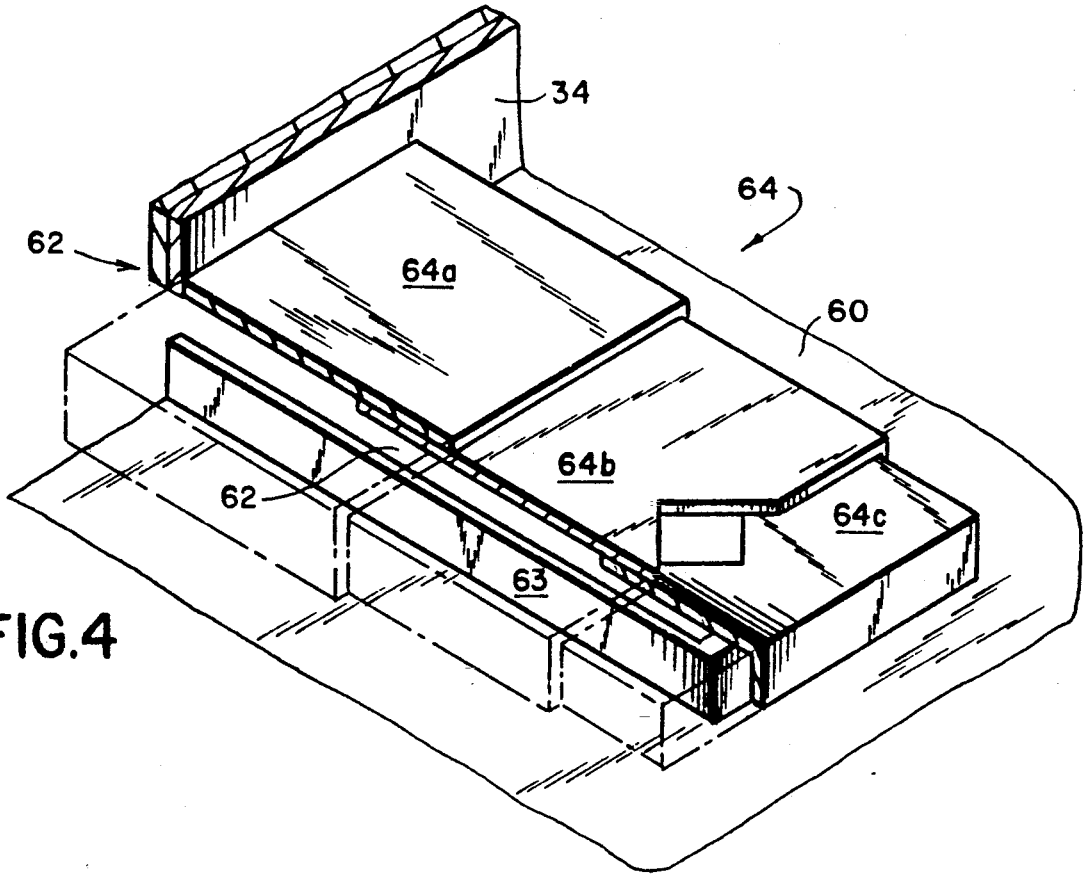
FIG. 4 is a top perspective view of the oi recovery basin, particularly showing the sliding covers and adjustable size opening created over the slot in the oil recovery basin.
Figure 6:
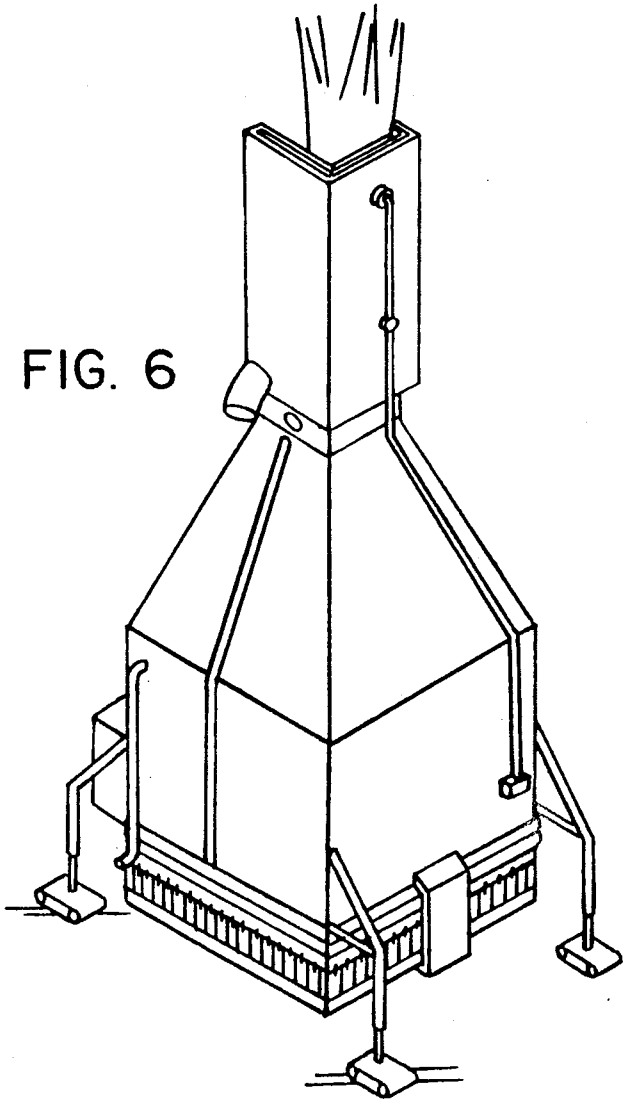
FIG. 6 is a perspective view of the apparatus of the invention in which the housing has been lowered into position on the ground surrounding a wellhead from which the fire has been reloacted to the top of the housing.
Figure 5:
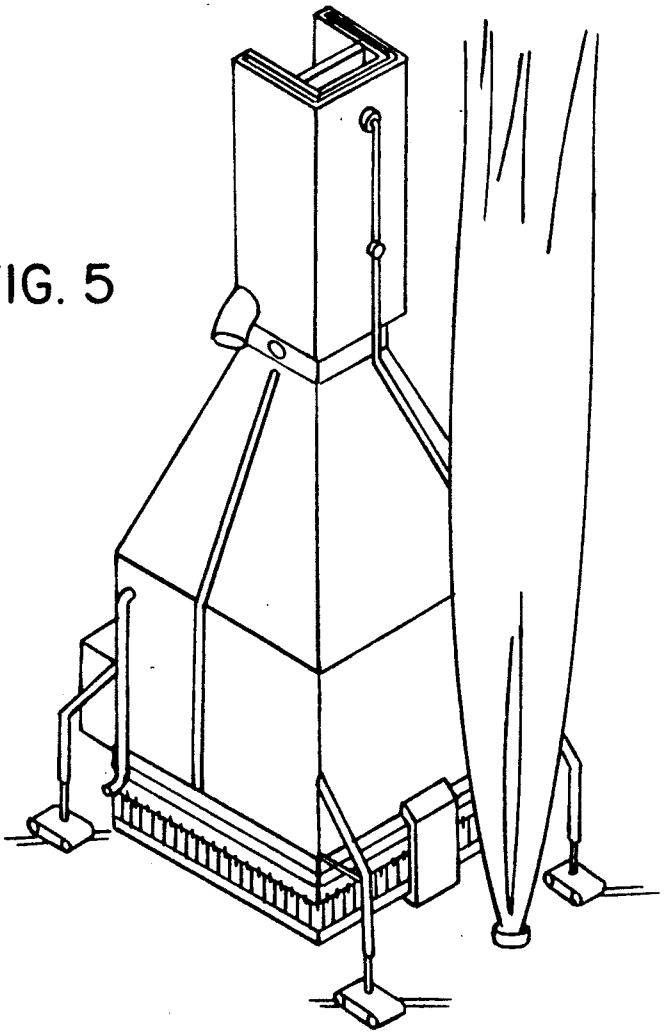
FIG. 5 is a perspective view of the apparatus of the invention in its raised, mobile configuration, prior to its being positioned over a wellhead fire and lowered into position.

Referring now to FIGS. 2, 3, and 4, gas/liquid separation/recovery assembly 58 is positioned within separation/recovery section 6. Oil recovery basin 60 is provided with slot 62 that extends from front wall 12 to at least a little past the center of recovery basin 60 and is defined by slot lip 63 about the periphery to prevent liquids from spilling back down through slot 62. Slot covers **64(*a*), 64(*b*) and 64(*c*) are movable to overlap and create an opening of adjustable dimensions to close off all but the portion of slot 62 through which the gusher is passing. Drain opening 66, with safety rails 68 thereabout, allows oil recovery through recovery pipe 70 to conventional collection vessels (not shown). Basin 60 is accessible to workers through accessway 72 that has peripheral splash lip 74 to prevent liquids from flowing down accessway 72 into work section 4 below. Accessway 72 is reached, for example, by ladder 76 extending to the base of housing 2. Accessway splash protection cover 78 protects ladder 76 from oil spraying from slot 62**.

Basin 60 is configured or positioned with respect to the vertical axis of housing 2 to provide a downward incline, causing oil recovered thereby to pass to drain opening 66.

Accessway 72 also provides an opening sufficient to effect any necessary gas pressure equalization between separation/recovery section 6 and work section 4. Thus, gases will travel downward through accessway 72 if excessive gases are forced through slot 62 of recovery basin 60. Conversely, gases will travel upwards through accessway 72 if excessive gases issuing from the well impinge on surfaces in work section 4 rather than passing through slot 62.

Baffle 80 includes baffle plate 82 having a downwardly facing surface, attachment beams 84 that connect baffle plate 82 to the top of separation/recovery section 6, blast reinforcement 86 fixed to the bottom surface of baffle plate 82 for protection from the force of the gusher G, and geyser dispersion head 88 depending from the center of baffle plate 82. Baffle 80 is positioned above recovery basin 60 and is roughly perpendicular to the walls of separation/recovery section 6.

A passageway defined by the periphery of baffle plate 82 and the interior surface of the outside walls of the gas/liquid separation/recovery section 6 provides an opening having a cross-sectional area sufficient to slow the gas velocity enough such that oil droplets can fall to recovery basin 60. Oil droplets small enough to be carried upwards as mist are carried out exhaust stack opening 10 and are consumed by the fire relocated to or above stack outlet 10.

Referring again to FIGS. 1 and 2, after rising above the passageway, combustible gases from the wellhead gusher G pass up through exhaust stack 8 to atmosphere at exhaust stack outlet 10. The inner surfaces of exhaust stack 10 can optionally have a coating of fire protective material, such as fire brick, tile, or other similar materials. The fire that is being fed by these gases is thus relocated from the position of the wellhead to exhaust outlet 10 where they are flared off.

Fan and threaded rod mechanism 90 is used to adjust the area of exhaust stack outlet 10. Mechanism 90 is controlled manually from box 92 or altenatively from a gas exit velocity sensing device within stack 8. Overriding these controls is a backup pressure sensitive diaphragm also in box 92. These are operated through opening and closing lines 96(*a*) and 96(*b*), respectively. If the opening is too small, gases are forced out the base of work section 4. If the opening is too large, oxygen-containing atmosphere is permitted to enter and burning will take place within exhaust stack 8. The opening provided by exhaust stack outlet 10 is kept small enough that oxygen-containing atmosphere does not eddy back into it.

Ambient air inlet duct 98 and associated air inlet damper 104 are the primary control of the differential pressure between main compartment 4 and the flue gases between inner flexible skirt 42 and outer flexible skirt 44 and, thus, the pressure in work section 4. Opening and closing of duct 98 is done by damper 104 under control of and responsive to pressure sensitive diaphragm 100 through opening and closing lines 102(*a*) and 102(*b*), respectively. Adjacent to air inlet duct outlet 106 is pilot light 108. Burning inside the bottom of stack 8 is fed by the controlled amount of incoming ambient air.

If an excessive gas pressure occurs in work section 4, then oxygen-containing ambient air can enter at the base of exhaust stack 8 where burning will take place at pilot light 108, thus creating a "chimney effect" in exhaust stack 8 that will reduce the pressure in work section 4 below.

Air inlet damper 104 is open just enough to maintain slightly lower pressure in the work compartment 4 than is being produced by the flue gas generators (not shown) for the space between inner skirt 42 and outer skirt 44. In this way, leaks around the base of housing 2 will be minimal and whatever leaks do occur will be small amounts of flue gas into the work compartment.

Exhaust stack opening 10 can be kept sufficiently closed to impart a higher exit velocity to the gases exiting opening 10. This velocity can be increased but must be kept to carry the flame high above exhaust stack outlet 10 within the constraints of maintaining the desired pressure differential in work area 4 as can be maintained and controlled by adjusting air inlet damper 104.

In order to avoid releasing unburned natural gas into the atmosphere it is desirable to reignite the burnable exhaust gases high above well blowout safety environment and fire relocation apparatus 1 after it mixes with ambient air. This can be accomplished in a variety of ways, including small rockets, tracers, and the like.

Flue gas jacket 109 coaxially surrounds exhaust stack 8 and opens at gas jacket outlet 110. Like flexible flue gas pipe 48*b*, discussed above, flexible flue gas pipe 48*a* provides input of noncombustible, non-oxygen bearing flue gas from an external source (not shown). Flue gas jacket 109 allows for ejecting fast moving flue gases surrounding the flammable gases issuing from exhaust stack 8. The parallel layers of laminar flow of gases thus established maintains separation of flammable gases from ambient oxygen until the gases are well removed from exhaust stack outlet 10.

Before containment apparatus 1 is positioned around the gusher to be controlled, exhaust stack outlet 10 and the opening at the bottom of housing 2 are covered, such as with sheet plastic, tarpaulin, or the like. The interior of housing 2 is then purged by replacement of ambient atmosphere with flue gases from the flue gas generators. The effect of this is that the fire is deprived of oxygen as soon as blast blade 30 passes through the face of the gusher.

Containment apparatus 1 is centered over the burning gusher and immediately lowered to the ground. Only a few seconds normally elapse between the time blast blade 30 is driven through the burning gusher until the sides are fairly well sealed. Any oxygen that gets inside will be rapidly consumed. Optionally, water can be sprayed inside housing 2 to form steam for displacement of the oxygen in order to shorten the time that the inside of the structure is subject to flame.

An equilibrium is established wherein the fire has been removed to exhaust stack outlet 10, there is no oxygen within the structure and there is little, if any, oil raining or into the work area of the geyser. As gas and oil continue to be forced from the wellhead into the structure, the temperature inside gradually diminishes to that of the gas issuing from the well. The temperatures achieved provide an acceptable working environment. Three effects are taking place: (i) cooling at the bottom of the well where gas expansion is taking place, (ii) heating due to friction of the gases on the wellhead production pipe as they rush to the surface, and (iii) heat exchange with the ground through which the pipe is passing.

There is thus established a large enclosed area around the gushing well site wherein there is no danger of fire, the temperature is not too hot for work, and little if any oil is raining down on the workers to blur their vision or otherwise hamper their operations. There is sufficient room overhead for whatever eqiuipment may be needed and the structure itself can be used as an overhead crane or other apparatus. If there are any leaks at the base of the main compartment, it will be noncombustible flue gases rather than oxygen-containing atmosphere that is introduced into the work area of the main compartment. Workers are not restricted in their use of tool because there is no danger of causing an explosion or of reigniting the gushing oil. Acetylene cutting torches, spark producing grinders, hammers, and arc welders can be safely used.

What is claimed is:

1. A mobile apparatus providing a safe environment for controlling oil wellhead blowouts at a wellhead and fires at such wellhead blowouts comprising:

a housing having a substantially oxygen-free interior environment and comprising (i) a main compartment providing a work section encompassing the wellhead and (ii) an exhaust stack having an interior continuous with that of the main compartment and an outlet to which any wellhead fire present is relocated;

means associated with the housing for purging the housing of any flammable or oxygen-containing, fire supportive gases therein;

means for introducing a nonflammable oxygen-free gas in the housing;

means for controllably releasing the flammable gases from the housing;

means for maintaining a gas pressure in the housing that is less than that established by the means for introducing the nonflammable oxygen-free gas and greater than ambient pressure;

means attached to the housing for accessing the main compartment while not compromising the oxygen-free environment therein; and means for extinguishing any wellhead fire so relocated.

2. The apparatus of claim 1 wherein the main compartment is provided with a base for contact with a surface surrounding the wellhead, and the exhaust stack is provided with an adjustable outlet.

3. The apparatus of claim 2 wherein the main compartment further comprises a skirt surrounding the base of the main compartment and comprising means for maintaining the main compartment in substantially gastight contact with the surface surrounding the wellhead.

4. The apparatus of claim 2 wherein, above the work section, a gas-liquid separation-recovery assembly comprising (i) means within the housing for separating liquids from gases emanating from the wellhead and (ii) means for recovering the liquids so separated.

5. The apparatus of claim 1 wherein the means for accessing the main compartment comprises a gas exchange chamber having gastight inner and outer chamber portals, and means for positive pressure exchange of gases in the gas exchange chamber.

6. The apparatus of claim 5 wherein the means for positive pressure gas exchange comprises means for positive pressure introduction of flue gas into the gas exchange chamber and exit means for the gas being exchanged.

7. The apparatus of claim 1 which further comprises means within the housing for separating liquids from gases emanating from the wellhead.

8. The apparatus of claim 7 wherein the separating means comprises at least one baffle that temporarily retains the liquids impinging on it while not preventing the flow of the gases from the housing.

9. The apparatus of claim 7 which further comprises means for recovering the liquids so separated.

10. The apparatus of claim 9 wherein the recovery means comprises a recovery basin that is positioned below the means for separating the liquids from the gases so as to collect the liquids so separated and is provided with means for passing the liquids so collected exterior to the housing.

11. A method for providing a safe environment for controlling oil wellhead blowouts at a wellhead and fires at such wellhead blowouts comprising:

enclosing the wellhead in a substantially oxygen-free interior work environment having an outlet to which any wellhead fire present is relocated;

introducing a nonflammable oxygen-free gas in the interior work environment;

controllably releasing flammable gases from the interior work environment;

maintaining a gas pressure in the interior work environment that is less than that established by the nonflammable oxygen-free gas so introduced and greater than ambient pressure; and extinguishing any wellhead fire so relocated.

12. A mobile apparatus providing a safe environment for controlling oil wellhead blowouts at a wellhead and fires at such wellhead blowouts comprising:

a housing having a substantially oxygen-free interior environment and comprising (i) a main compartment providing a work section encompassing the wellhead and (ii) an exhaust stack having an interior continuous with that of the main compartment and an outlet to which any wellhead fire present is relocated;

means associated with the housing for controllably purging the housing of any flammable or oxygen-containing, fire supportive gases comprising means for regulating nonturbulent flow rate out of the exhaust stack outlet manually or under control of a mechanism sensitive to maintain a gas pressure in the housing sufficiently greater than ambient pressure to sustain an equilibrium of outward gas flow;

means attached to the housing for accessing the main compartment while not compromising the oxygen-free environment therein; and means for extinguishing any wellhead fire so relocated.

* * * * *